United States Patent [19]

Doyel

[11] 3,961,551

[45] June 8, 1976

[54] HAND-OPERATED DEVICE FOR SLITTING FABRIC INTO STRIPS

[76] Inventor: John S. Doyel, 404 W. 20th. St., New York, N.Y. 10011

[22] Filed: Aug. 22, 1975

[21] Appl. No.: 606,777

[52] U.S. Cl. ..... 83/648; 83/545; 83/698; 83/858; 83/DIG. 1

[51] Int. Cl.[2] ..... B26D 3/12

[58] Field of Search ..... 83/648, 545, 858, 698, 83/DIG. 1

[56] References Cited

UNITED STATES PATENTS

| | | | |
|---|---|---|---|
| 1,306,992 | 7/1919 | Barrile et al. | 83/648 X |
| 1,812,901 | 7/1931 | Rohner | 83/648 X |
| 2,547,249 | 4/1951 | Bell | 83/648 X |
| 3,709,081 | 1/1973 | Rush | 83/648 X |

*Primary Examiner*—Frank T. Yost
*Attorney, Agent, or Firm*—Cooper, Dunham, Clark, Griffin & Moran

[57] ABSTRACT

Disclosed is a hand-operated device for slitting fabric drawn therethrough into strips. The device has a V-shaped bracket which is secured over the edge of a table top by a wedge, without using any tools. Fabric is drawn by hand from the edge toward the interior of the table top between a row of blades extending upwardly from the device and a guard bar disposed over the blades. The device can be disassembled, without using any tools, to reposition the blades so as to cut strips of different widths or to replace blades. Except for the blades, the device is entirely formed of an inexpensive plastic material formed by a process such as molding.

6 Claims, 7 Drawing Figures

Fig. 1.
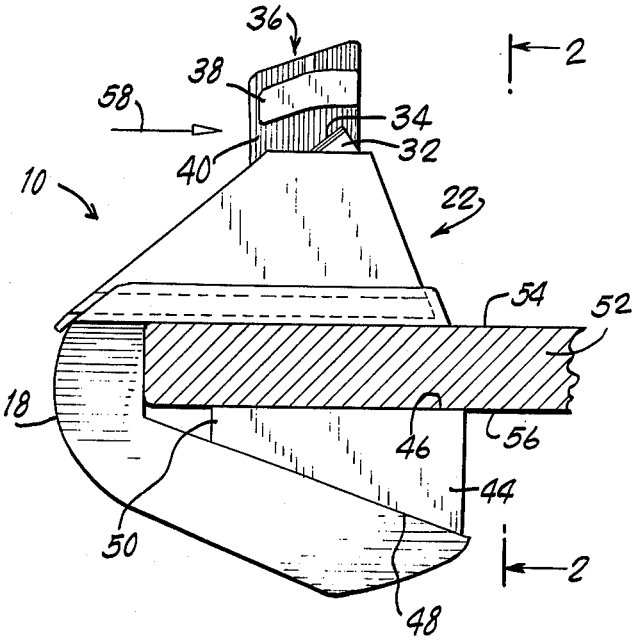
Fig. 2.
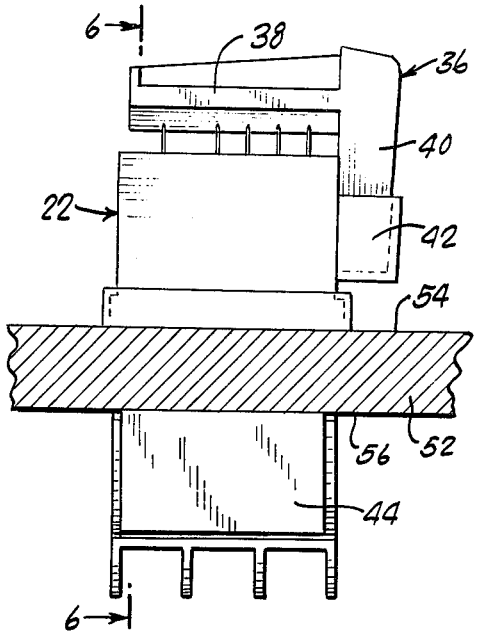
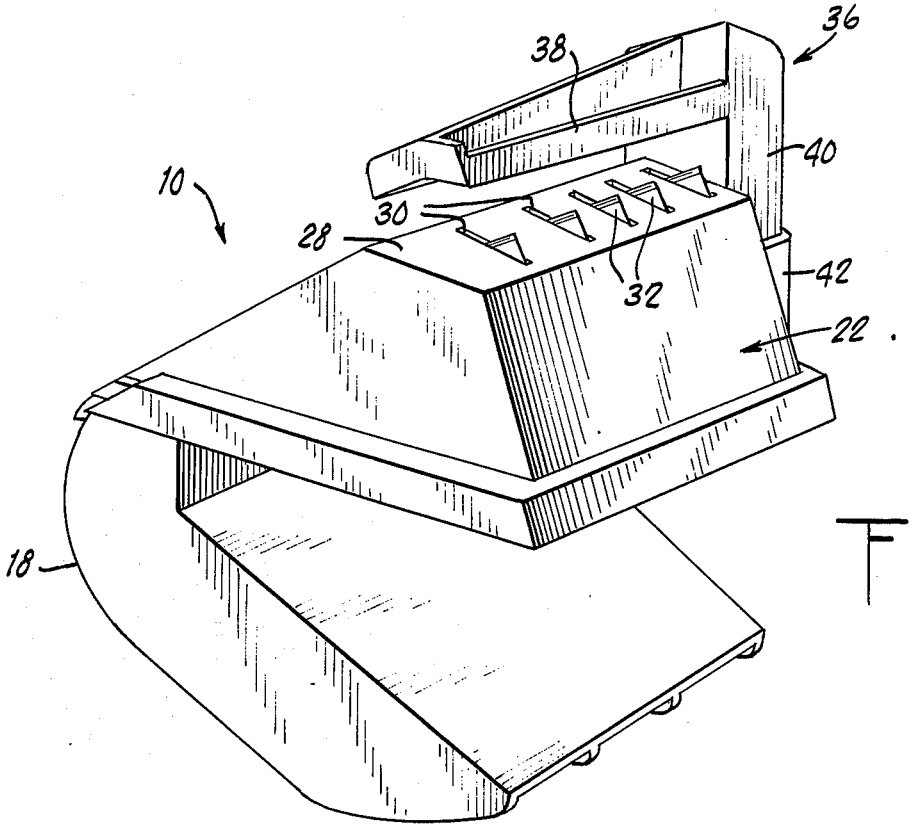
Fig. 3.

HAND-OPERATED DEVICE FOR SLITTING FABRIC INTO STRIPS

BACKGROUND AND SUMMARY OF THE INVENTION

The invention is in the field of hand operated devices for slitting fabric or similar sheet material into strips and is particularly suitable for use by hobyists for conveniently slitting surplus fabric or similar sheet material into strips for use instead of yarn in tufting or weaving rugs by hand.

In hobby activities such as tufting or weaving rugs it is often desirable to cut otherwise unneeded fabric or similar sheet material into strips that can be used instead of yarn. While there are many industrial devices for slitting sheet material into webs or strips, they are typically not suitable for home use by hobyists because of their size and cost and because they are designed for slitting uniform pieces of sheet material rather than the odd-sized, surplus fabric pieces typically used by the hobyists. Since a hobyist may need a substantial length of such fabric strips in an activity such as weaving a rug, using shears to cut the strips is time consuming and tiring. There is a need therefore for an inexpensive and simple device which would be convenient for home use in cutting fabric and similar sheet material into strips, and the invention is directed to providing device of this type which is inexpensive, simple to mount on a table top and to remove, safe and simple to operate, convenient to adjust for cutting strips of different width, and easy to maintain. There are some prior art hand-operated devices for shredding or slitting sheet material (see, for example, U.S. Pat. Nos 3,883,953 and 3,709,081), but such devices typically do not have sufficient versatility, sufficiently low cost or sufficient ease of use for widespread use by home hobyists.

The invented device comprises a generally V-shaped bracket having two legs forming a generally V-shaped notch therebetween. One leg fits over the top surface of a table top and the other leg goes under the undersurface of the table top. A wedge is inserted between the bottom leg and the table top to fixedly secure the bracket to the table top. A blade unit is removably secured to the top leg of the bracket and comprises a convex, hollow blade support cover and a convex blade support nesting in it. The blade support has several rows of projections supporting a row of blades each extending from the back towards the front of the device and sloping upwardly in moving toward the front. A portion of the sharp edge of each blade protrudes through a corresponding slot in the blade support cover. An L-shaped guard bar has a horizontal arm extending over the blade portions protruding through the blade support cover and a vertical portion frictionally received in a sleeve extending from the side of the device.

The device is easily secured to a table top by hand, without the need for any tools, and is easily disassembled by hand and without tools to change blades or to change the relative positions of the blades so as to cut strips of a different width. The blade unit is secured to the top bracket leg by a key and groove connection and is removed from the bracket by sliding it backwardly and out of the bracket. The blade support is then removed by hand from the blade support cover to expose the blades held thereby. The blades are in blade slits formed by projection extending from the top surface of the blade support. The projection forming a blade slit are offset from each other along the length of the slit so that a blade support with slits for retaining thin blades can be formed by a process such as molding a thermoplastic material.

BRIEF DESCRIPTION OF THE DRAWINGS

FIG. 1 is a side elevational view of the invented fabric slitter secured to a table top.

FIG. 2 is a front elevational view thereof.

FIG. 3 is a perspective view of the fabric slitter.

DETAILED DESCRIPTION

Figure 4:
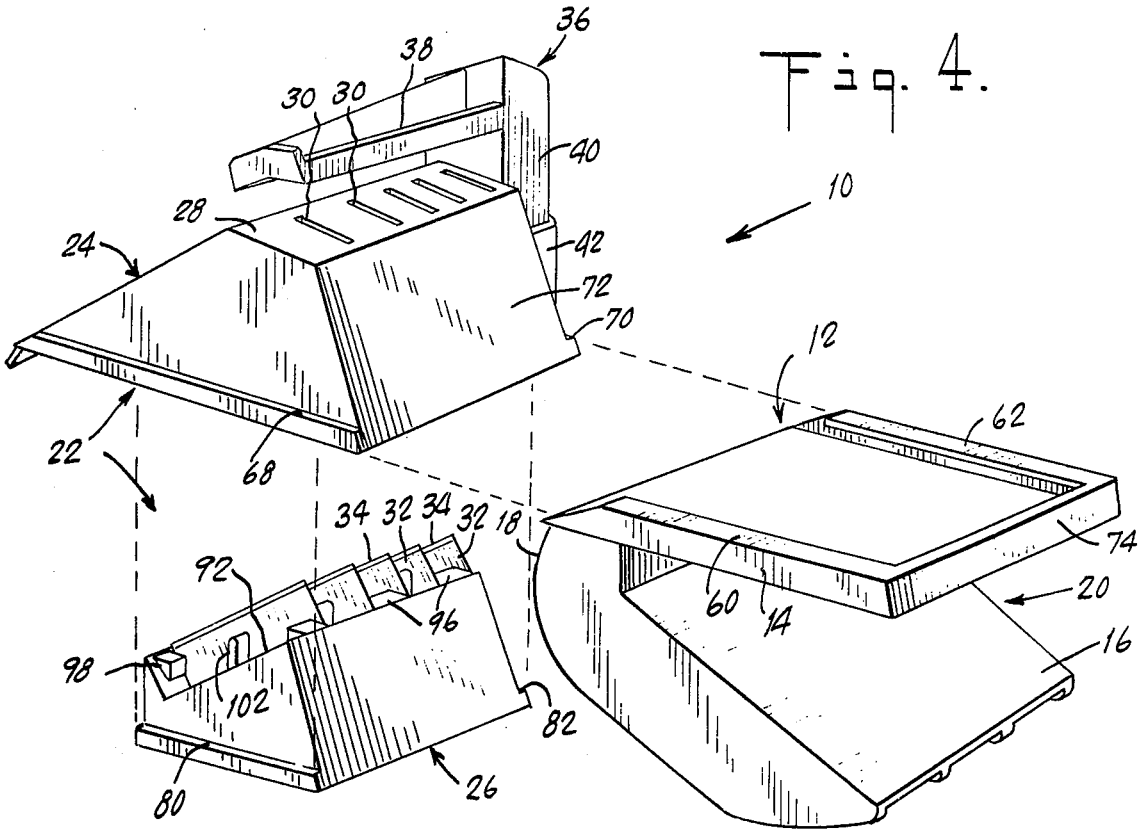
FIG. 4 is an exploded perspective view thereof.

Referring to FIGS. 1-5, and particularly to FIG. 4, the fabric slitter generally shown at 10 comprises a bracket 12 formed of a top leg 14 and a bottom leg 16 which join at their back end at a region 18 and extend divergently forwardly therefrom to form a generally V-shaped notch 20. A blade unit 22 is removably secured to the top leg 14 and comprises a generally convex, hollow blade support cover 24 and a generally convex blade support 26 removably nesting in the cover 24. The cover 24 has a top wall 28 formed with a laterally extending row of elongated slots 30 each extending forwardly, and the blade support 26 has means for holding a laterally extending row of blades 32 each extending forwardly and protruding upwardly through a slot 30 in the cover 24. The protruding portion of each blade 32 has a sharpened edge 34 sloping upwardly from the back towards the front of the device. An L-shaped guard bar 36 has a laterally extending arm 38 spaced from and extending over the protruding portions of the blades 32 and a downwardly extending arm 40 which is frictionally received slidably in a sleeve 42 formed integrally with the blade support cover 24. A wedge 44 has a top wall 46 and a bottom wall 48 which converge toward a sharp end 50 at an angle matching that of the V-shaped notch 20 formed by the legs of the bracket 12.

The fabric slitter 10 is secured to a table top 52 by fitting the table top within the notch 20, with the top leg 14 over the top surface 54 of the table top and the bottom leg 16 under the underside 56 of the table top. The wedge 44 is inserted between the table top 52 and the bottom leg 16, with the sharp end 50 of the wedge pointing toward the back region 18 of the bracket 12, and the wedge is forced toward the back region 18 to thereby secure frictionally the device 10 to the table top 52. When the device 10 is so secured, a sheet of fabric (not shown) is drawn by hand along the direction indicated by the arrow 54 in FIG. 1, with the bottom surface of the fabric pressed downwardly against the top surface 28 of the blade support cover 24 and with one edge of the fabric adjacent the inner surface 40a of the leg 40 of the guard 36. The fabric is thereby slit by the blades 30 into strips whose widths are determined by the distances between adjacent blades (and by the distance between the arm 40 of the guard bar 36 and the blade nearest thereto). It should be clear that the term table top is meant to include any board-like surface which can fit within the V-shaped notch 20 and that the table top 52 need not be horizontal but may be vertical or oblique. While the fabric slitter is described for convenience as being attached to a horizontal table top 52, it should be clear that it can be similarly attached to a table top or a similar surface having a different orientation with respect to the horizon.

Figure 5:
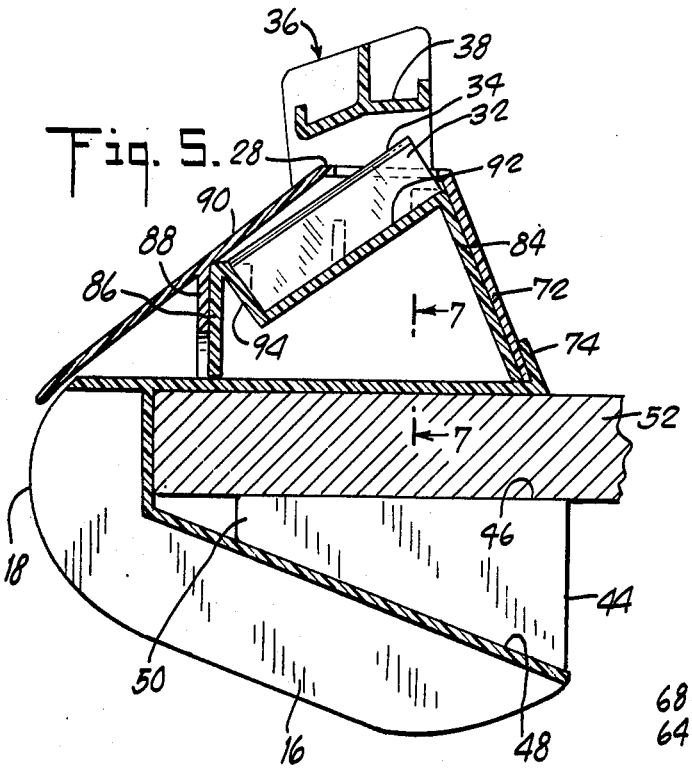
FIG. 5 is a sectional view taken along 5—5 of FIG. 2.
Figure 7:
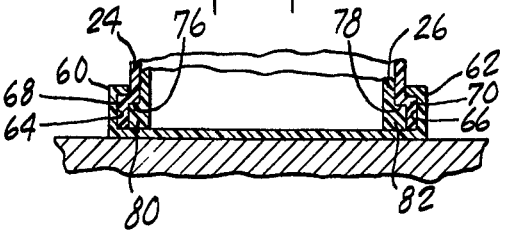
FIG. 7 is a partial sectional view taken along line 7—7 of FIG. 5.

Referring to FIGS. 4, 5 and 7, the blade unit 22 is secured to the top leg 14 of the bracket 12 by a key and groove connection. The bracket leg 14 has lips 60 and 62 extending upwardly from the lateral edges of the leg and forming grooves 64 and 66 opening toward and facing each other across the width of the top leg 14. The blade support cover 24 has matching keys 68 and 70 which extend along the lower lateral edges thereof and fit slidingly within the grooves 64 and 66 respectively. The cover 24 is secured to the bracket 12 by sliding the keys 68 and 70 into the grooves 64 and 66 from the back toward the front of the top leg 14 and moving the cover 24 forwardly until its front wall 72 engages a lip 74 extending upwardly from the front edge of the top leg 14.

The leg support 26 nests releasably within the leg support cover 24, with the upper portion of each blade 32 supported thereby protruding upwardly through a matching blade slot 30 in the top wall 28 of the blade support cover 24. Referring to FIG. 7, the cover 24 is formed with lands 76 and 78 running internally along its lateral lower edges and the blade support 26 is formed with extension 80 and 82 running along its lateral lower edges thereof which fit within the keys 68 and 70 of the cover 24 and against the lands 76 and 78 thereof. In the nested position, the leg support 26 is completely within the cover 24, with its front and back walls 84 and 86 against the front wall 72 and a back wall 88 respectively of the cover 24, and with the top edge of the back wall 86 of the blade support 26 against the under side of the top wall 90 of the cover 26.

Figure 6:
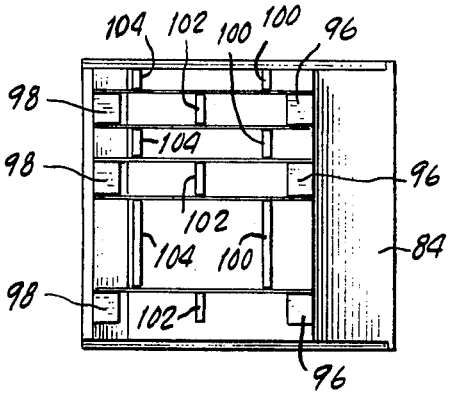
FIG. 6 is a top plan view of a blade support forming a part of the fabric splitter.

Referring to FIGS. 4 and 5, the blade support 26 has a top wall 92 sloping upwardly in moving from the back toward the front of the support 26 and a back wall 94 extending upwardly from the back end of the top wall 92 and at a right angle thereto. Referring to FIGS. 4, 5 and 6, a front row of projections 96 extends laterally along the front end of the top wall 92, with each projection 96 extending upwardly, and a back row of projections 98 extends laterally along the back wall 94, with each projection 98 extending upwardly and forwardly of the back wall 96. There are several intermediate rows of additional projections, each intermediate row extending laterally and being intermediate the front and back rows. As best seen in FIG. 6, there is an intermediate row of projections 100, a parallel intermediate row of projections 102 and another intermediate row of projections 104. The projections define therebetween a plurality of parallel blade slits running from back to front and receiving thin, rectangular blades 32 whose upper edges 34 are sharp and extend along a plane sloping upwardly in moving from the back to the front of the device 10 (i.e., from the edge to the interior of the table top 52). It is noted that the projections defining any one blade slit are offset from each other along the length of the slit, and no two projections are directly opposite each other across a blade. This feature is important because it allows the blade support 26 to be molded integrally from a plastic material and to securely hold the thin blades 32 in a correspondingly narrow blade slits without further machining operation. If the projections were arranged opposite each other across a blade, the blade support 26 could not be formed by a molding operation and blade slits would have had to be cut by a subsequent machining operation.

Each of the bracket 12, blade support 26, blade support cover 24 and the sleeve 42 which is integral therewith, and the guard bar 36 is integrally formed of a substantially homogeneous material by a process such as molding a thermoplastic material. The blades 32 are inserted in the blade slits formed by the projections extending from the top and back walls 92 and 94 by hand, and the fabric slitter is assembled by hand: by nesting the blade support 26 within the cover 24 such that the top portions of the blade 32 protrude through the blade slot 30 and the bottom surfaces of the support 26 and cover 24 are flush with each other, sliding the blade units 22 into the top leg 14 until the front wall 70 of the cover 24 engages the lip 74 of the leg 14, and fitting the guard bar 36 by inserting its downwardly extending leg 40 into the sleeve 42 of the cover 24. The fabric slitter can then be secured to a table top or a similar surface as discussed above, by fitting the V-notch 20 over the edge of the table top and fitting the wedge 44 between the underside of the table top and the bottom leg 16.

It should be appreciated that the invented fabric slitter is inexpensive to manufacture since it is entirely made (except for the blades) of components made by a process such as molding a thermoplastic material, and that it is easy to assemble and disassemble and to affix to and remove from a table surface since all of these operations are done by hand without the need for any tools. It should also be appreciated that a fabric may be slit into strips of different widths by arranging the blades 32 accordingly. For example, while there are five blades in the embodiment shown in the Figures, any one to four of the blades may be removed, to leave less than 5 blades in a desired pattern. For example, if it is desired to cut several narrow strips, then only the first through the fourth blades counting from the top down in FIG. 6 would be left in place; to cut wider strips the first, third and fifth blades may be removed; to cut still wider strips, all of the blades except the fifth one may be removed, etc. It should also be appreciated that the guard bar 36 provides protection, when in place, against the possibility of injury by the blades 32, but that the guard bar 36 may be removed and the fabric slitter can then be grasped in hand and used for cutting as a multi-bladed, hand-held knife.

I claim:

1. A hand-operated device for slitting fabric drawn therethrough into springs comprising:

a bracket formed of a top leg and a bottom leg joined at their back end and extending divergently forwardly therefrom to form therebetween a generally V-shaped notch;

a blade unit secured to the bracket, said blade unit comprising a generally convex, hollow blade support cover and a generally convex blade support removably nesting in the cover, said cover having a top wall formed with a laterally extending row of elongated slots each extending forwardly, and said support having means for holding a laterally extending row of blades each extending forwardly and protruding upwardly through a corresponding one of said slots in the cover, the protruding portion of each blade having a sharpened edge sloping upwardly in extending from the back toward the front of the bracket;

a guard bar extending laterally over the protruding portions of the blades and spaced upwardly therefrom; and a wedge having two opposite walls converging towards a sharp end at an angle matching that of the V-shaped notch formed by the bracket;

said device engaging a table top by moving the bracket from the edge toward the interior of the table top, with the top bracket leg over the top surface of the table top and with the bottom leg under the underside of the table top, and pressing the inner side of one leg flat against the table top by inserting the sharp end of the wedge between the other leg and the table top and forcing the wedge toward the back of the bracket, said device slitting fabric into strips by drawing the fabric forwardly between the top surface of the blade support cover and the facing surface of the guard bar while pressing the fabric downwardly over the sharpened edges of the blades.

2. A device as in claim 1 wherein the top leg of the bracket includes a forwardly extending groove and the blade unit includes a matching, forwardly extending key slidably received in said groove, and including stop means for restricting the extent of the forward movement of the blade unit with respect to the bracket, said blade unit being removable from the bracket by sliding it backwardly and out of the groove therein and the cover being removable from the blade support nested therein to expose the means for holding the blades.

3. A device as in claim 2 wherein the means for holding the blades comprise a plurality of projections formed integrally with the blade support and extending upwardly from a top surface thereof, each blade being received frictionally in a blade slit defined by a plurality of projections which are offset from each other along the length of the blade slit.

4. A device as in claim 3 wherein the top leg of the bracket includes a sleeve disposed laterally of the leg and having an open top side, and the guard bar includes a downwardly extending arm slidably received frictionally in said sleeve, said guard bar being removable from the bracket by sliding the arm thereof upwardly and out of the sleeve.

5. A device as in claim 4 wherein each of the brackets, blade support, blade support cover, wedge, and guard bar is integrally formed of a substantially homogeneous material.

6. A device as in claim 1 wherein the blade support has a top blade supporting surface extending along a sloping plane parallel to the sharpened edges of the blade and a blade base supporting surface extending upwardly from the back end of said top blade supporting surface, and wherein the blade holding means comprise a front row of projections extending upwardly along the front of said top blade supporting surface, a back row of projections extending upwardly and forwardly of said blade base supporting surface, and at least one intermediate row of projections extending parallel to said front and back rows and intermediate thereof, said projections defining therebetween a plurality of blade slits and the projections facing the same blade slit being offset from each other along the length of the blade slit.

* * * * *